US010131136B2

(12) United States Patent
Schaede

(10) Patent No.: US 10,131,136 B2
(45) Date of Patent: Nov. 20, 2018

(54) SIMULTANEOUS RECTO-VERSO PRINTING PRESS

(71) Applicant: KBA-NotaSys SA, Lausanne (CH)

(72) Inventor: Johannes Georg Schaede, Würzburg (DE)

(73) Assignee: KBA-NOTASYS SA, Lausanne (CH)

( * ) Notice: Subject to any disclaimer, the term of this patent is extended or adjusted under 35 U.S.C. 154(b) by 0 days.

(21) Appl. No.: 15/524,496

(22) PCT Filed: Nov. 6, 2015

(86) PCT No.: PCT/IB2015/058575
§ 371 (c)(1),
(2) Date: May 4, 2017

(87) PCT Pub. No.: WO2016/071870
PCT Pub. Date: May 12, 2016

(65) Prior Publication Data

US 2017/0326870 A1 Nov. 16, 2017

(30) Foreign Application Priority Data

Nov. 7, 2014 (EP) ..... 14192392

(51) Int. Cl.
*B41F 7/00* (2006.01)
*B41F 7/06* (2006.01)
(Continued)

(52) U.S. Cl.
CPC ..... *B41F 7/06* (2013.01); *B41F 7/08* (2013.01); *B41F 7/12* (2013.01); *B41F 21/08* (2013.01); *B41F 7/00* (2013.01)

(58) Field of Classification Search
CPC ..... B41F 7/00; B41F 7/06; B41F 7/08; B41F 7/12; B41F 21/08; B41F 33/0036
See application file for complete search history.

(56) References Cited

U.S. PATENT DOCUMENTS 5,152,222 A * 10/1992 Okamura ..... B41F 7/12 101/178
6,101,939 A 8/2000 Giori et al.
(Continued)

FOREIGN PATENT DOCUMENTS

DE 21 15 790 10/1972
DE 10 2006 024595 11/2007
(Continued)

OTHER PUBLICATIONS

International Search Report and Written Opinion of the ISA for PCT/IB2015/058575, dated Dec. 21, 2015, 10 pages.
(Continued)

*Primary Examiner* — Matthew G Marini
*Assistant Examiner* — Marissa Ferguson-Samreth
(74) *Attorney, Agent, or Firm* — Nixon & Vanderhye P.C.

(57) ABSTRACT

There is described a recto-verso printing press (100*) adapted to carry out simultaneous recto-verso printing of sheets, the printing press (100*) comprising a main printing group (5, 6, 15, 16, 25, 26) with first and second printing cylinders (5, 6) cooperating with one another to form a first printing nip between the first and second printing cylinders (5, 6) where first and second sides of sheets are simultaneously printed, the first printing cylinder (5) acting as a sheet conveying cylinder of the main printing group (5, 6, 15, 16, 25, 26). The printing press (100*) further comprises an additional printing group (7, 8, 17, 18, 27, 28) with third and fourth printing cylinders (7, 8) cooperating with one another to form a second printing nip between the third and fourth printing cylinders (7, 8) where the first and second sides of the sheets are simultaneously printed, the third printing cylinder (7) acting as a sheet conveying cylinder of the additional printing group (7, 8, 17, 18, 27, 28). The main printing group (5, 6, 15, 16, 25, 26) and the additional
(Continued)

printing group (7, 8, 7, 18, 27, 28) are coupled to one another by means of an intermediate sheet conveying system comprising one or more sheet-transfer cylinders (10, 10', 10") interposed between the first and third printing cylinders (5, 7).

16 Claims, 3 Drawing Sheets

(51) Int. Cl.

| | |
|---|---|
| ***B41F 7/08*** | (2006.01) |
| ***B41F 7/12*** | (2006.01) |
| ***B41F 21/08*** | (2006.01) |

(56) References Cited

U.S. PATENT DOCUMENTS

| | | | | |
|---|---|---|---|---|
| 8,065,957 | B2 | 11/2011 | Schaede et al. | |
| 8,499,690 | B2 | 8/2013 | Schwitzky | |
| 8,528,477 | B2 | 9/2013 | Schaede et al. | |
| 8,869,697 | B2 | 10/2014 | Kress et al. | |
| 8,943,967 | B2 | 2/2015 | Hans et al. | |
| 9,238,358 | B1 * | 1/2016 | Kamoda | B41F 11/02 |
| 2001/0054364 | A1 * | 12/2001 | Kusaka | B41F 33/0036 101/483 |
| 2008/0271620 | A1 | 11/2008 | Hoier et al. | |
| 2009/0007807 | A1 | 1/2009 | Schaede et al. | |
| 2009/0025594 | A1 | 1/2009 | Schaede et al. | |
| 2010/0089261 | A1 | 4/2010 | Schwitzky | |
| 2010/0139511 | A1 * | 6/2010 | Schaede | B41F 9/002 101/156 |
| 2012/0199025 | A1 * | 8/2012 | Funada | B41F 7/025 101/416.1 |
| 2013/0319269 | A1 * | 12/2013 | Turke | B41F 9/021 101/174 |
| 2014/0158007 | A1 | 6/2014 | Kress et al. | |
| 2014/0238257 | A1 | 8/2014 | Hans et al. | |

FOREIGN PATENT DOCUMENTS

| | | | | |
|---|---|---|---|---|
| EP | 0 949 069 | | 10/1999 | |
| EP | 2574461 | * | 4/2013 | B41F 7/12 |
| FR | 1471667 | A | 3/1967 | |
| JP | 06-155699 | A | 6/1994 | |
| JP | 11-320817 | A | 11/1999 | |
| JP | 2009-530130 | A | 8/2009 | |
| JP | 2010-047019 | A | 3/2010 | |
| WO | WO 2007/042919 | | 4/2007 | |
| WO | 2007/105059 | A1 | 9/2007 | |
| WO | WO 2007/105059 | | 9/2007 | |
| WO | WO 2007/105061 | | 9/2007 | |
| WO | WO 2008/099330 | | 8/2008 | |
| WO | WO 2013/001009 | | 1/2013 | |
| WO | WO 2013/001010 | | 1/2013 | |
| WO | WO 2013/001518 | | 1/2013 | |

OTHER PUBLICATIONS

Mar. 19, 2018 Communication Pursuant to Article 94(3) EPC issued in European Application No. 15 797 448.6.

Mar. 13, 2018 Notice of Rejection issued in Japanese Application No. 2017-523850.

* cited by examiner

SIMULTANEOUS RECTO-VERSO PRINTING PRESS

This application is the U.S. national phase of International Application No. PCT/IB2015/058575 filed 6 Nov. 2015, which designated the U.S. and claims priority to EP Patent Application No. 14192392.0 filed 7 Nov. 2014, the entire contents of each of which are hereby incorporated by reference.

TECHNICAL FIELD

The present invention generally relates to a recto-verso printing press adapted to carry out simultaneous recto-verso printing of sheets. More precisely, the invention relates to such a printing press that comprises a main printing group with first and second printing cylinders cooperating with one another to form a first printing nip between the first and second printing cylinders where first and second sides of sheets are simultaneously printed, the first printing cylinder acting as a sheet conveying cylinder of the main printing group.

BACKGROUND OF THE INVENTION

Such printing presses are known as such in the art, in particular from European Patent Publication No. EP 0 949 069 A1 and International PCT Publications Nos. WO 2007/042919 A2, WO 2007/105059 A1, WO 2007/105061 A1 and WO 2008/099330 A2, which publications are all incorporated herein by reference in their entirety.

International PCT Publication No. WO 2007/042919 A2 in particular discloses such a recto-verso printing press that further comprises an additional printing group placed upstream of a main printing group of the printing press.

FIGS. 1 and 2 illustrate such a recto-verso printing press that is adapted to carry out simultaneous recto-verso printing of sheets, as typically used for the production of banknotes and like security documents, which printing press is designated globally by reference numeral 100. Such printing press is in particular marketed by the present Applicant under the product designation Super Simultan® IV. The basic configuration of the printing press 100 shown in FIGS. 1 and 2 is similar to that shown and discussed with reference to FIG. 1 of International PCT Publication No. WO 2007/042919 A2.

This printing press 100 comprises a printing unit 2, which is specifically adapted to perform simultaneous recto-verso printing of the sheets (according to the so-called Simultan-offset printing principle) and comprises, as is typical in the art, two blanket cylinders (or printing cylinders) 5, 6 rotating in the direction indicated by the arrows and between which the sheets are fed to receive multicolour impressions. In this example, blanket cylinders 5, 6 are three-segment cylinders which are supported between a pair of side frames designated by reference numeral 20. The blanket cylinders 5, 6 receive and collect different ink patterns in their respective colours from plate cylinders 15 and 16 (four on each side) which are distributed around a portion of the circumference of the blanket cylinders 5, 6. These plate cylinders 15 and 16, which each carry a corresponding printing plate, are themselves inked by corresponding inking apparatuses 25 and 26, respectively. The two groups of inking apparatuses 25, 26 are advantageously supported in two inking carriages 21, 22 that can be moved toward or away from the centrally-located plate cylinders 15, 16 and blanket cylinders 5, 6.

As is known in the art, each printing plate is wrapped around the corresponding plate cylinder 15, 16 and clamped at its leading end and trailing end by a suitable plate clamping system, which plate clamping system is located in a corresponding cylinder pit of the plate cylinder (see e.g. International (PCT) Publications Nos. WO 2013/001518 A2, WO 2013/001009 A1 and WO 2013/001010 A2, which are also incorporated herein by reference in their entirety).

Sheets are fed from a sheet feeder 1 onto a feeder table located next to the printing unit 2 (on the right-hand side in FIGS. 1 and 2) to a succession of transfer cylinders 9, 8', 10 (three cylinders in this example) placed upstream of the blanket cylinders 5, 6. While being transported by the transfer cylinder 8', the sheets receive a first impression on one side of the sheets using an additional printing group, the transfer cylinder 8' fulfilling the additional function of impression cylinder. This additional printing group consists of, in addition to the transfer cylinder 8', a blanket cylinder 8 (a two-segment cylinder in this example) that collects inks from two plate cylinders 18 that are inked by corresponding inking apparatuses 28. The inking apparatuses 28 are advantageously supported in an inking carriage 24 that can be moved toward or away from the plate cylinders 18 and blanket cylinder 8. The sheets that are printed by means of the additional printing group are first dried/cured by a drying/curing unit (not referenced in FIGS. 1 and 2) while being transported by the sheet transfer cylinder 8' before being transferred to the downstream-located main printing group.

In the example of FIGS. 1 and 2, the sheets are transferred onto the surface of blanket cylinder 5 where a leading edge of each sheet is held by appropriate gripper means located in cylinder pits between each segment of the blanket cylinder 5. Each sheet is thus transported by the blanket cylinder 5 to the printing nip between the blanket cylinders 5 and 6 where simultaneous recto-verso printing occurs. Once printed on both sides, the printed sheets are then transferred, as known in the art, to a sheet conveying system 3 (such as a chain gripper system with spaced-apart gripper bars) for delivery in a sheet delivery unit 4 comprising multiple (e.g. three) delivery pile units. Reference numeral 31 in FIG. 2 designates a pair of chain wheels located at the upstream end of the sheet conveying system 3.

In the example of FIGS. 1 and 2, first and second transfer cylinders or drums 11, 12, such as suction drums or cylinders, are interposed between the sheet conveying system 3 and the blanket cylinder 5. These first and second transfer cylinders 11, 12 are optional and designed to carry out inspection of the sheets on the recto and verso sides as described for instance in International application No. WO 2007/105059 A1. Reference numerals 61, 62 in FIG. 2 designate corresponding inspection cameras (such as line-scan cameras) that cooperate with cylinder or drums 11, 12.

A limitation of the known solutions as described above resides in the fact that the additional printing group is only capable of printing one side of the sheets.

There is therefore a need for an improved solution, especially such a solution that expands the printing capabilities of the printing press

SUMMARY OF THE INVENTION

A general aim of the invention is to improve the known printing presses of the aforementioned type.

More precisely, an aim of the present invention is to provide such a printing press that allows to print both sides of the sheets with additional features, thereby increasing the anti-counterfeiting protection of the resulting documents.

Another aim of the present invention is to provide such a printing press where machine footprint is not increased compared to existing printing presses of similar type.

A further aim of the invention is to provide such a printing press where machine accessibility and maintenance operations are not compromised.

These aims are achieved thanks to the printing press defined in the claims. In particular there is provided a recto-verso printing press adapted to carry out simultaneous recto-verso printing of sheets, the printing press comprising a main printing group with first and second printing cylinders cooperating with one another to form a first printing nip between the first and second printing cylinders where first and second sides of sheets are simultaneously printed, the first printing cylinder acting as a sheet conveying cylinder of the main printing group. The printing press further comprises an additional printing group with third and fourth printing cylinders cooperating with one another to form a second printing nip between the third and fourth printing cylinders where the first and second sides of the sheets are simultaneously printed, the third printing cylinder acting as a sheet conveying cylinder of the additional printing group. The main printing group and the additional printing group are coupled to one another by means of an intermediate sheet conveying system comprising one or more sheet-transfer cylinders interposed between the first and third printing cylinders.

In accordance with the invention, it will therefore be understood that the main printing group and the additional printing group are both configured to carry out simultaneous recto-verso printing of the sheets. This considerably expands the level of security that can be achieved with the printing press.

In accordance with a preferred embodiment of the invention, the additional printing group is preferably placed upstream of, even more preferably above, the main printing group. In this context, the first and second printing cylinders, on the one hand, and the third and fourth printing cylinders, on the other hand, can advantageously be aligned along two horizontal planes, which ensures optimal machine accessibility, especially for the purpose of carrying out maintenance operations.

In addition, in the context of the aforementioned preferred embodiment, the printing press may further comprise first and second drying/curing devices to dry/cure ink applied by the additional printing group on the first and second sides of the sheets, respectively, prior to printing by the main printing group. In this respect, the intermediate sheet conveying system may advantageously comprise first, second and third sheet-transfer cylinders, the first sheet-transfer cylinder cooperating with the first printing cylinder and the second sheet-transfer cylinder, the third sheet-transfer cylinder cooperating with the second sheet-transfer cylinder and the third printing cylinder. In such case, the first drying/curing device can conveniently cooperate with the third sheet-transfer cylinder, while the second drying/curing device cooperates with the second sheet transfer cylinder.

The aforementioned first and second drying/curing devices are advantageously UV curing devices, preferably UV-LED curing devices.

In accordance with an advantageous embodiment of the invention, the main printing group may further comprise a first set of plate cylinders cooperating with the first printing cylinder and which are inked by a first set of inking apparatuses, and a second set of plate cylinders cooperating with the second printing cylinder and which are inked by a second set of inking apparatuses. Likewise, the additional printing group may further comprise a third set of plate cylinders cooperating with the third printing cylinder and which are inked by a third set of inking apparatuses, and a fourth set of plate cylinders cooperating with the fourth printing cylinder and which are inked by a fourth set of inking apparatuses. In this particular context, the first and third sets of inking apparatuses and the second and fourth sets of inking apparatuses are preferably supported in retractable inking carriages.

In accordance with a particularly advantageous variant of the aforementioned embodiment, the main printing group is a m-over-m printing group comprising a first set of m plate cylinders cooperating with the first printing cylinder and a second set of m plate cylinders cooperating with the second printing cylinder, m being preferably equal to 4. Likewise, the additional printing group is a n-over-n printing group comprising a third set of n plate cylinders cooperating with the third printing cylinder and a fourth set of n plate cylinders cooperating with the fourth printing cylinder, n being preferably equal to 2. This allows unprecedented printing capabilities with a printing press configuration that remains very compact.

As a further improvement, the printing press can be equipped with automatic blanket washing devices adapted to clean the first, second, third and fourth printing cylinders during maintenance operations.

Another refinement may include the provision of a recto-verso inspection system adapted to inspect the first and second sides of the sheets printed by the additional printing group and the main printing group, the recto-verso inspection system preferably including at least one inspection cylinder or drum positioned upstream of a sheet conveying system of the printing press.

Further advantageous embodiments of the invention form the subject-matter of the dependent claims and are discussed below.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which.

DETAILED DESCRIPTION OF EMBODIMENTS OF THE INVENTION

The present invention will be described in the particular context of a sheet-fed recto-verso printing press exhibiting a (m+n)-over-(m+n) configuration (see FIG. 3 where m, n respectively equal 4 and 2). It shall be appreciated however that the invention is not limited to this particular embodiment, the number of plate cylinders being purely illustrative. This being said, a symmetric configuration as shown in FIG. 3 is of particular advantage in that the printing press may make use of two sets of substantially identical components.

In the context of the present invention, the expression "printing cylinder(s)" will be used to designate the relevant cylinders of the main printing group and of the additional printing group that directly cooperate with the first and second sides of the sheets to transfer printing patterns thereon. This expression is however interchangeable with the expression "blanket cylinder", it being to be understood that the relevant printing cylinders each carry a number of printing blankets.

The expression "first side" and "second side" are used in the following description to designate the two opposite sides of the sheets being printed. More precisely, in the illustration of FIG. 3, the "first side" designates the side of the sheets that is designated by the white triangles, while the "second side" designates the side of the sheets that is designated by the black triangles. These expressions are however interchangeable.

Figure 3:
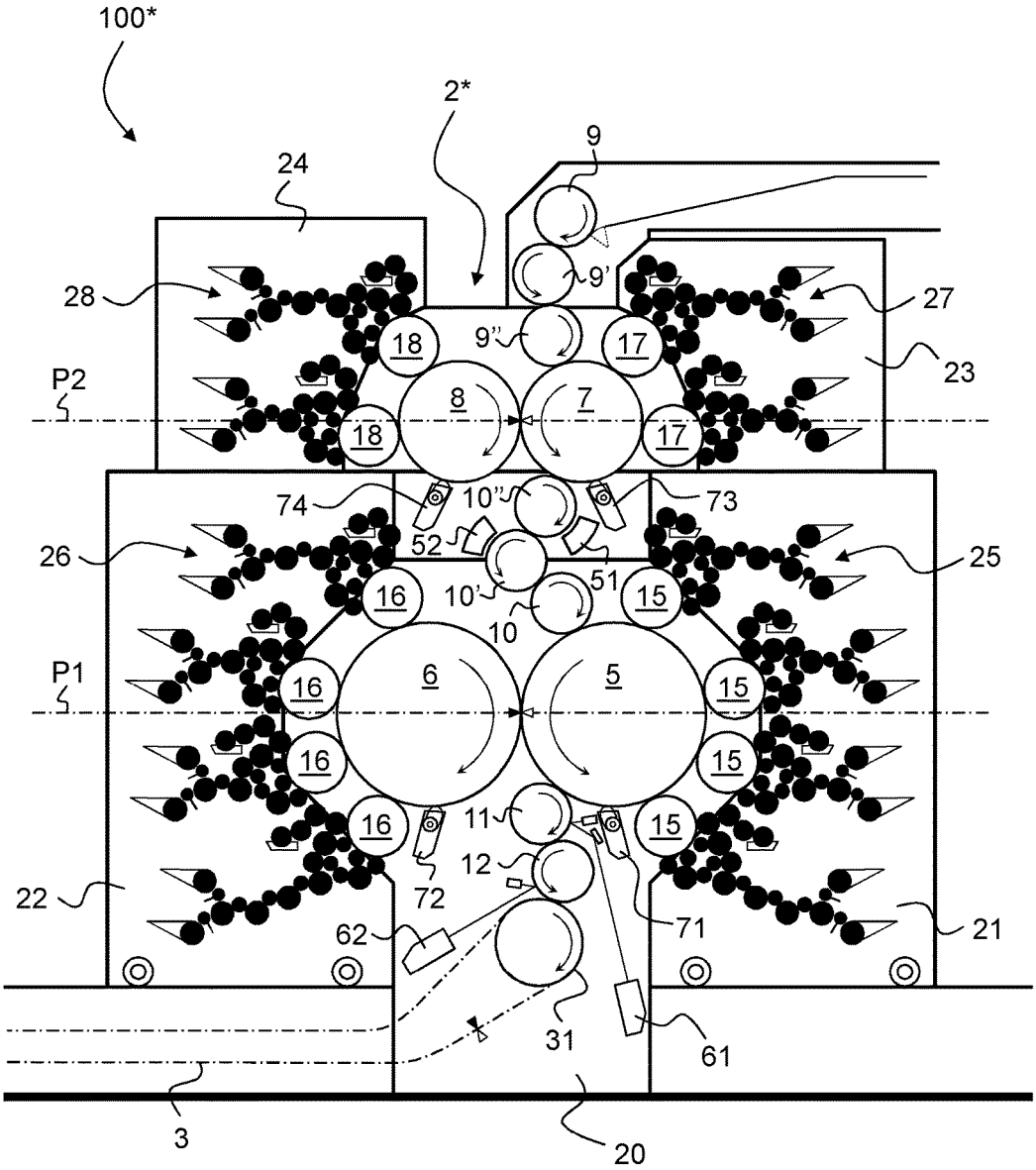
FIG. 3 is a schematic partial side view of the printing unit of a printing press in accordance with a preferred embodiment of the invention.

FIG. 3 schematically shows a partial side view of a printing unit, designated by reference numeral 2*, of a printing press 100* in accordance with a preferred embodiment of the invention.

The printing press 100* comprises a main printing group consisting of elements 5, 6, 15, 16, 25, 26, including first and second printing cylinders 5, 6 cooperating with one another to form a first printing nip between the first and second printing cylinders 5, 6 where the first and second sides of the sheets are simultaneously printed, the first printing cylinder 5 acting as a sheet conveying cylinder of the main printing group. The configuration of the main printing group is as such identical to that of the main printing group illustrated in FIGS. 1 and 2. In this embodiment, printing cylinders 5, 6 are likewise three-segment cylinders which are supported between a pair of side frames 20. The printing cylinders 5, 6 receive and collect different ink patterns in their respective colours from first and second sets of four (m=4) plate cylinders 15, respectively 16, which are distributed around a portion of the circumference of the printing cylinders 5, 6. These plate cylinders 15 and 16, which each carry a corresponding printing plate, are again inked by corresponding sets of four inking apparatuses 25 and 26, respectively. The two sets of inking apparatuses 25, 26 are preferably supported in two retractable inking carriages 21, 22 that can be moved toward or away from the centrally-located plate cylinders 15, 16 and printing cylinders 5, 6.

Figure 1:
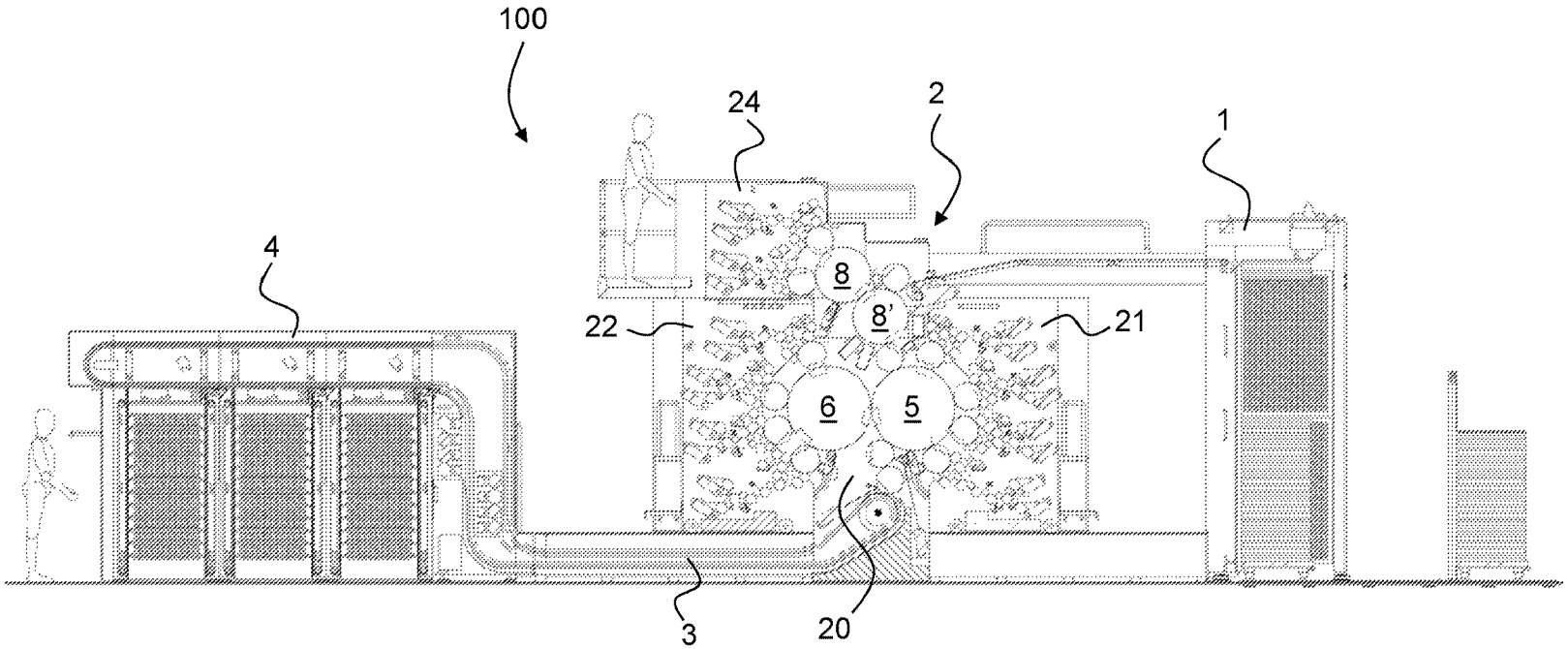
FIG. 1 is schematic illustration of recto-verso printing press exhibiting a configuration similar to that disclosed in International PCT Publication No. WO 2007/042919 A2.
Figure 2:
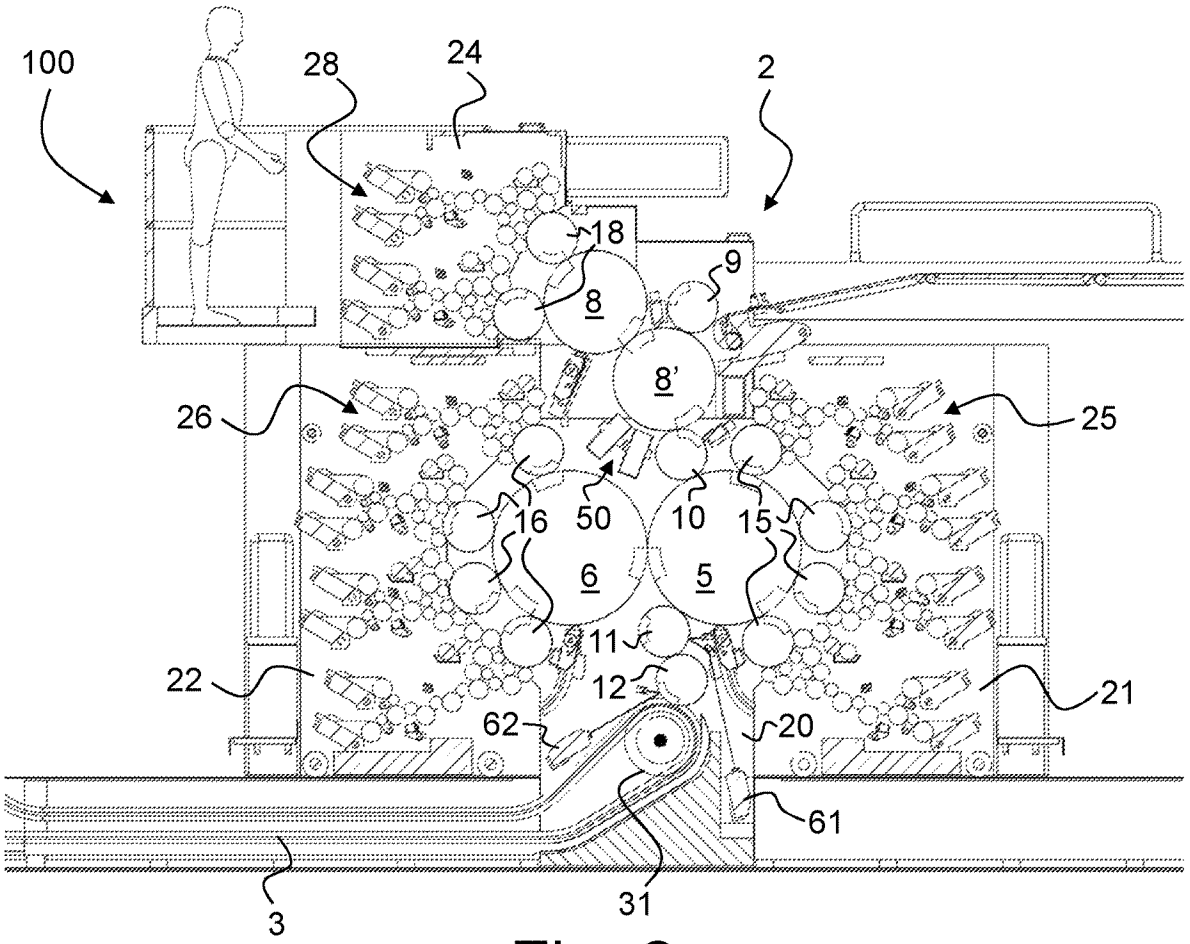
FIG. 2 is a schematic partial side view of the printing unit of the printing press of FIG. 1.

In contrast to the configuration illustrated in FIGS. 1 and 2, the additional printing group comprises third and fourth printing cylinders 7, 8 cooperating with one another to form a second printing nip between the third and fourth printing cylinders 7, 8 where the first and second sides of the sheets are simultaneously printed, the third printing cylinder 7 acting as a sheet conveying cylinder of the additional printing group. Each printing cylinder 7, 8 collects inks from corresponding sets of two (n=2) plate cylinders 17, respectively 18, that are inked by corresponding inking apparatuses 27, 28. These two sets of inking apparatuses 27, 28 are likewise preferably supported in two retractable inking carriages 23, 24 that can be moved toward or away from the centrally-located plate cylinders 17, 18 and printing cylinders 7, 8.

Alternatively, the sets of inking apparatus 25, 27 on the right side of the printing unit 2 and/or the sets of inking apparatus 26, 28 on the left side of the printing unit 2 could be supported in one and a same inking carriage (one on each side).

In the illustrated example, the additional printing group 7, 8, 17, 18, 27, 28 is placed upstream of and above the main printing group 5, 6, 15, 16, 25, 26, the first and second printing cylinders 5, 6, on the one hand, and the third and fourth printing cylinders 7, 8, on the other hand, being advantageously aligned along two horizontal planes P1, P2.

The main printing group 5, 6, 15, 16, 25, 26 and the additional printing group 7, 8, 17, 18, 27, 28 are coupled to one another by means of an intermediate sheet conveying system comprising, in the illustrated embodiment, first to third sheet-transfer cylinders 10, 10', 10" interposed between the first and third printing cylinders 5, 7. More precisely, the sheets printed in the additional printing group 7, 8, 17, 18, 27, 28 are transferred from the third printing cylinder 7 in succession to the third sheet-transfer cylinders 10", to the second sheet-transfer cylinders 10', to the first sheet-transfer cylinder 10, and then to the first printing cylinder 5 of the main printing group.

On their way to the main printing group 5, 6, 15, 16, 25, 26, the sheets are preferably dried/cured by first and second drying/curing devices 51, 52. As illustrated, the first drying/curing device 51 advantageously cooperates with the third sheet-transfer cylinder 10", i.e. the sheet-transfer cylinder located immediately downstream of the third printing cylinder 7, and the second drying/curing device 52 cooperates with the second sheet-transfer cylinder 10'. The drying/curing devices 51, 52 are advantageously UV curing devices, preferably UV-LED curing devices.

Drying/curing of the second side of the sheets could alternatively be performed directly onto the third printing cylinder 7, provided suitable measures are taken to ensure that the drying/curing device does not degrade the performance or usability of the printing blankets on the third printing cylinder 7.

The sheets to be printed are fed in succession from the sheet feeder (not shown in FIG. 3) onto the feeder table where they are conventionally aligned before being fed to a succession of three sheet transfer cylinders 9, 9', 9" at the infeed. As illustrated, the sheets are fed in succession by the sheet transfer cylinders 9, 9', 9" to the third printing cylinder 7.

It will therefore be appreciated that the sheets receive first and second impressions on both sides which are performed simultaneously at the printing nip between the third and fourth printing cylinders 7, 8 of the additional printing group and at the printing nip between the first and second printing cylinders 5, 6 of the main printing group.

The (4+2)-over-(4+2) configuration illustrated in FIG. 3 allows unprecedented printing capabilities with a printing press configuration that remains very compact. It should be appreciated that the actual numbers m and n of plate cylinders 15, 16, 17, 18 illustrated in FIG. 3 is not limitative and that other combinations are possible. This being said, the illustrated example is particularly advantageous in that it does not increase machine footprint, does not compromise machine accessibility and still allows maintenance operations to be carried out in an optimal manner.

As a possible refinement of the invention, it may be convenient to additionally provide the printing press with a recto-verso inspection system 11, 12, 61, 62 adapted to inspect the first and second sides of the sheets printed by the additional printing group and the main printing group, as already discussed in connection with the example of FIGS. 1 and 2.

Furthermore, the printing press 100* of FIG. 3 can also conveniently equipped, as illustrated, with automatic blanket washing devices 71, 72, 73, 74 adapted to clean the first, second, third and fourth printing cylinders 5, 6, 7, 8, respectively, during maintenance operations.

Various modifications and/or improvements may be made to the above-described embodiments without departing from the scope of the invention as defined by the annexed claims. In particular, while the illustration of FIG. 3 shows a (4+2)-over-(4+2) configuration, other configurations are possible.

LIST OF REFERENCE NUMERALS USED THEREIN

100 printing press (FIGS. 1 and 2)
100* printing press (embodiment of FIG. 3)
1 sheet feeder
2 printing unit (FIGS. 1 and 2)
2* printing unit (embodiment of FIG. 3)
3 sheet conveying system (chain gripper system with spaced-apart gripper bars)
4 sheet delivery unit
5 sheet conveying cylinder/(first) printing cylinder (main printing group)/three-segment blanket cylinder
6 (second) printing cylinder (main printing group)/three-segment blanket cylinder
7 sheet conveying cylinder/(third) printing cylinder (additional printing group)/two-segment blanket cylinder (FIG. 3 only)
8 (fourth FIG. 3) printing cylinder (additional printing group)/two-segment blanket cylinder
8' sheet conveying cylinder/two-segment cylinder (FIGS. 1 and 2 only)
9, 9', 9" sheet transfer cylinders (infeed)
10, 10', 10" sheet transfer cylinders (intermediate sheet conveying system interposed between additional printing group and main printing group)
11 inspection cylinder or drum (part of inspection system)
12 inspection cylinder or drum (part of inspection system)
15 (m=4) plate cylinders cooperating with printing cylinder 5
16 (m=4) plate cylinders cooperating with printing cylinder 6
17 (n=2) plate cylinders cooperating with printing cylinder 7
18 (n=2) plate cylinders cooperating with printing cylinder 8
20 printing press main frame
21 retractable inking carriage supporting inking apparatuses 25
22 retractable inking carriage supporting inking apparatuses 26
23 retractable inking carriage supporting inking apparatuses 27
24 retractable inking carriage supporting inking apparatuses 28
25 (m=4) inking apparatuses each cooperating with a corresponding one of the plate cylinders 15
26 (m=4) inking apparatuses each cooperating with a corresponding one of the plate cylinders 16
27 (n=2) inking apparatuses each cooperating with a corresponding one of the plate cylinders 17
28 (n=2) inking apparatuses each cooperating with a corresponding one of the plate cylinders 18
31 pair of chain wheels of sheet conveying system 3 (upstream end)
50 drying/curing device (FIGS. 1, 2)
51 drying/curing device (first side of sheets), e.g. UV-LED curing device
52 drying/curing device (second side of sheets), e.g. UV-LED curing device
61 inspection camera (first side of sheets) cooperating with inspection cylinder or drum 11, e.g. line-scan camera
62 inspection camera (second side of sheets) cooperating with inspection cylinder or drum 12, e.g. line-scan camera
71 automatic blanket washing device cooperating with printing cylinder 5
72 automatic blanket washing device cooperating with printing cylinder 6
73 automatic blanket washing device cooperating with printing cylinder 7
74 automatic blanket washing device cooperating with printing cylinder 8
P1 horizontal plane along which printing cylinders 5, 6 are aligned
P2 horizontal plane along which printing cylinders 7, 8 are aligned

The invention claimed is:

1. A recto-verso printing press adapted to carry out simultaneous recto-verso printing of sheets, the printing press comprising a main printing group with first and second printing cylinders cooperating with one another to form a first printing nip between the first and second printing cylinders where first and second sides of sheets are simultaneously printed, the first printing cylinder acting as a sheet conveying cylinder of the main printing group, wherein the printing press further comprises an additional printing group with third and fourth printing cylinders cooperating with one another to form a second printing nip between the third and fourth printing cylinders where the first and second sides of the sheets are simultaneously printed, the third printing cylinder acting as a sheet conveying cylinder of the additional printing group, and in that the main printing group and the additional printing group are coupled to one another by means of an intermediate sheet conveying system comprising one or more sheet-transfer cylinders interposed between the first and third printing cylinders, wherein the main printing group further comprises:

a first set of plate cylinders cooperating with the first printing cylinder and which are inked by a first set of inking apparatuses; and a second set of plate cylinders cooperating with the second printing cylinder and which are inked by a second set of inking apparatuses, and wherein the additional printing group further comprises:

a third set of plate cylinders cooperating with the third printing cylinder and which are inked by a third set of inking apparatuses; and a fourth set of plate cylinders cooperating with the fourth printing cylinder and which are inked by a fourth set of inking apparatuses.

2. The printing press according to claim 1, wherein the additional printing group is placed upstream of the main printing group.

3. The printing press according to claim 2, wherein the additional printing group is placed above the main printing group.

4. The printing press according to claim 3, wherein the first and second printing cylinders, on the one hand, and the third and fourth printing cylinders, on the other hand, are aligned along two horizontal planes.

5. The printing press according to claim 2, further comprising first and second drying/curing devices to dry/cure ink applied by the additional printing group on the first and second sides of the sheets, respectively, prior to printing by the main printing group.

6. The printing press according to claim 5, wherein the intermediate sheet conveying system comprises first, second and third sheet-transfer cylinders, the first sheet-transfer cylinder cooperating with the first printing cylinder and the second sheet-transfer cylinder, the third sheet-transfer cylinder cooperating with the second sheet-transfer cylinder and the third printing cylinder, and wherein the first drying/curing device cooperates with the third sheet-transfer cylinder and wherein the second drying/curing device cooperates with the second sheet transfer cylinder.

7. The printing press according to claim 5, wherein the first and second drying/curing devices are UV curing devices.

8. The printing press according to claim 7, wherein the first and second drying/curing devices are UV-LED curing devices.

9. The printing press according to claim 1, wherein the intermediate sheet conveying system comprises first, second and third sheet-transfer cylinders, the first sheet-transfer cylinder cooperating with the first printing cylinder and the second sheet-transfer cylinder, the third sheet-transfer cylinder cooperating with the second sheet-transfer cylinder and the third printing cylinder.

10. The printing press according to claim 1, wherein the first and third sets of inking apparatuses and the second and fourth sets of inking apparatuses are supported in retractable inking carriages.

11. The printing press according to claim 1, wherein the main printing group is a m-over-m printing group comprising a first set of m plate cylinders cooperating with the first printing cylinder and a second set of m plate cylinders cooperating with the second printing cylinder, and wherein the additional printing group is a n-over-n printing group comprising a third set of n plate cylinders cooperating with the third printing cylinder and a fourth set of n plate cylinders cooperating with the fourth printing cylinder.

12. The printing press according to claim 11, wherein m is equal to 4.

13. The printing press according to claim 11, wherein n is equal to 2.

14. The printing press according to claim 1, further comprising automatic blanket washing devices adapted to clean the first, second, third and fourth printing cylinders during maintenance operations.

15. The printing press according to claim 1, further comprising a recto-verso inspection system adapted to inspect the first and second sides of the sheets printed by the additional printing group and the main printing group.

16. The printing press according to claim 15, wherein the recto-verso inspection system includes at least one inspection cylinder or drum positioned upstream of a sheet conveying system of the printing press.

* * * * *